US010364603B2

(12) United States Patent
Grillberger

(10) Patent No.: US 10,364,603 B2
(45) Date of Patent: Jul. 30, 2019

(54) ACCESS CONTROL DEVICE

(71) Applicant: NOVOMATIC AG, Gumpoldskirchen (AT)

(72) Inventor: Walter Grillberger, Herzogsdorf (DE)

(73) Assignee: NOVOMATIC AG, Gumpoldskircen (AT)

( * ) Notice: Subject to any disclaimer, the term of this patent is extended or adjusted under 35 U.S.C. 154(b) by 174 days.

(21) Appl. No.: 15/023,573

(22) PCT Filed: Sep. 19, 2014

(86) PCT No.: PCT/EP2014/002545

§ 371 (c)(1),
(2) Date: Jun. 16, 2016

(87) PCT Pub. No.: WO2015/039760

PCT Pub. Date: Mar. 26, 2015

(65) Prior Publication Data

US 2016/0281424 A1 Sep. 29, 2016

(30) Foreign Application Priority Data

Sep. 20, 2013 (DE) ..... 20 2013 008 332 U
Jan. 10, 2014 (DE) ..... 20 2014 000 198 U

(51) Int. Cl.
*E05D 15/02* (2006.01)
*E06B 11/08* (2006.01)
(Continued)

(52) U.S. Cl.
CPC ..... *E06B 11/08* (2013.01); *E06B 3/90* (2013.01); *E06B 11/085* (2013.01); *G07C 9/02* (2013.01);
(Continued)

(58) Field of Classification Search
CPC . E06B 7/28; E06B 11/028; E06B 3/36; E06B 11/08; F21V 33/006; E05F 15/73; G02B 6/0068; G07C 9/02; F21Y 2105/00
(Continued)

(56) References Cited

U.S. PATENT DOCUMENTS 1,841,132 A 1/1932 Kennedy et al.
3,374,872 A * 3/1968 Theophile ..... G07C 9/02 194/225
(Continued)

FOREIGN PATENT DOCUMENTS

AT 509119 B1 12/2012
DE 2202746 A1 7/1973
(Continued)

OTHER PUBLICATIONS

Alvarado Manufacturing Co. "Security Turnstiles, Model CPST"; www.alvaradomfg.com; email: information@alvaradomfg.com; Alvarado Manufacturing Co., 12660 Colony St. Chino, CA 91710.
(Continued)

*Primary Examiner* — Jerry E Redman
(74) *Attorney, Agent, or Firm* — Avery N. Goldstein; Blue Filament Law PLLC

(57) ABSTRACT

The present invention relates to an access control device having at least one movably mounted barrier element, which can be moved to a blocking position, in which it blocks access, and an access position, in which access is enabled. In order to enable a variable use in different locations without time-consuming assembly, for example in order to variably delimit different spaces in a casino or an event location, the movable barrier element is mounted on a barrier support which includes free-standing ground contact means for the anchor-free, position-variable putting up of a barrier element on the ground. A lateral delimitation laterally
(Continued)

enclosing or extending the at least one barrier element has a modular design and can be assembled from a number of side pieces which can be variably joined end to end under different angles and which together form the lateral delimitation.

33 Claims, 8 Drawing Sheets

(51) Int. Cl.
*E06B 3/90* (2006.01)
*G07C 9/02* (2006.01)
*E04B 2/74* (2006.01)
*F21Y 105/00* (2016.01)
*F21Y 101/00* (2016.01)

(52) U.S. Cl.
CPC ..... *E04B 2/7435* (2013.01); *F21Y 2101/00* (2013.01); *F21Y 2105/00* (2013.01)

(58) Field of Classification Search
USPC ..... 49/42–45
See application file for complete search history.

(56) References Cited

U.S. PATENT DOCUMENTS 3,893,259 A 7/1975 Nineberg
3,913,717 A 10/1975 Collins
3,988,570 A * 10/1976 Murphy ..... G06Q 10/0635 194/210
4,026,069 A * 5/1977 Bohnett ..... A01K 3/00 119/840
4,184,289 A 1/1980 Lambertson
4,195,442 A * 4/1980 Keeling ..... E06B 11/085 49/35
4,344,628 A * 8/1982 Warehime ..... A62B 63/06 273/127 R
4,358,909 A 11/1982 Trikilis
5,349,781 A * 9/1994 Libardi ..... G07C 9/02 49/25
5,592,778 A 1/1997 McGuire
5,819,470 A 10/1998 Kionecka et al.
6,324,800 B1 * 12/2001 Valentz ..... E04D 13/12 248/346.01
6,780,501 B2 8/2004 Bruneau et al.
6,845,970 B1 * 1/2005 Kenton ..... E04H 17/18 256/73
6,873,266 B2 3/2005 Blum et al.
7,404,517 B2 7/2008 Wallerstorfer et al.
7,513,423 B2 4/2009 Kocznar et al.
7,553,103 B2 * 6/2009 Jameson ..... E01F 9/608 116/63 R
D602,175 S * 10/2009 Droomer ..... D25/133
7,707,951 B1 * 5/2010 Prasad ..... E05G 5/003 109/2
7,743,556 B2 * 6/2010 Stoffels ..... E05B 65/0007 256/73
7,823,338 B2 11/2010 Slagel et al.
8,079,515 B2 12/2011 Kocznar et al.
8,136,297 B2 3/2012 Bzorgi
8,269,603 B2 9/2012 Aoki et al.
8,657,190 B2 2/2014 Lais et al.
8,819,855 B2 * 8/2014 Prasad ..... G06F 21/78 713/193
9,206,642 B2 12/2015 Harucksteiner et al.
2002/0050098 A1 5/2002 Chan
2005/0056741 A1 * 3/2005 Higgs ..... E04G 21/3233 248/188.8
2005/0241234 A1 * 11/2005 Ginzel ..... E06B 3/90 49/42
2011/0100405 A1 5/2011 Fournier
2011/0292214 A1 * 12/2011 Plaster ..... G08B 13/183 348/159
2012/0024329 A1 2/2012 Ma
2012/0044047 A1 * 2/2012 Morgan ..... G07C 9/00111 340/5.2
2013/0062585 A1 3/2013 Deering
2013/0199094 A1 8/2013 Lachance et al.
2016/0284142 A1 9/2016 Elbling et al.
2016/0305141 A1 10/2016 Slagel

FOREIGN PATENT DOCUMENTS

DE 8510933 U1 5/1986
DE 8912064 U1 2/1990
DE 8912064 U1 3/1990
DE 4124567 A1 1/1993
DE 29724321 U1 12/2000
DE 20321489 U1 12/2007
DE 102006050635 A1 4/2008
DE 102010015774 A1 10/2011
DE 102010024108 A1 12/2011
DE 202012101181 U1 5/2012
EP 2234073 A1 9/2010
EP 2259226 A1 12/2010
EP 2306406 B1 4/2011
FR 891808 A 3/1944
FR 2176208 A5 10/1973
FR 2808048 A1 10/2001
WO 0129355 A1 4/2001
WO 0175243 A1 10/2001
WO 2004092524 A1 10/2004
WO 2007136244 A1 11/2007

OTHER PUBLICATIONS

International Search Report for PCT/EP2014/002545 filed on Sep. 19, 2014.
Alvarado Manufacturing Co., "Security Turnstiles, Model CPST", Alvarado Manufacturing Co., 12660 Colony Street, Chino, CA 91710, Jul. 18, 2009, 2 pages; https://web.archive.org/web/20090718095252/http:/www.alvaradomfg.com/pdf/datasheets/cpst_data.pdf.
German Search Report dated May 22, 2014 for German Application No. 20 2013 008 332.8 filed Sep. 20, 2013.
International Search Report dated Feb. 4, 2015 for International Application No. PCT/EP2014/002546 filed Sep. 19, 2014.

* cited by examiner

ACCESS CONTROL DEVICE

FIELD OF THE INVENTION

The present invention relates to an access control device having at least one movably mounted barrier element, which can be moved to a blocking position, in which it blocks access, and an access position, in which access is enabled.

BACKGROUND OF THE INVENTION

Such access control devices control the access to areas located behind the barrier element and can, for example, be used at buildings or places to control access for persons to the area located behind the device. Such access control devices can be found, for example, in security-sensitive buildings such as banks, casinos, airports, or buildings and places that require an entrance fee such as amusement parks, stadiums, and the like. In addition to controlling the access of persons, controlling the access of vehicles, such as motor vehicles or bicycles, can generally also be taken into consideration, as is already known, for example, in car parks, in the form of parking barriers.

In the blocking position of the barrier element, the barrier element thereby blocks an access path or an access port that leads into the area behind the device, while said access path is unblocked by the barrier element in the access position of the barrier element.

The barrier element can thereby form, for example, the arm of a turnstile and can be rotatably supported about the axis of rotation of the turnstile. Alternatively, however, the barrier element can also be a flap that can be swung back and forth, which is sometimes referred to as a flap gate, and which, for example, can be swung back and forth around an upright pivot axis, which pivot axis can be located next to the access path. The barrier element can, however, also be designed as a gate that can move up and down around a horizontal axis, for example, in the form of a blocking arm which can be moved from a lying barrier position, that runs across the access path, to an upright access position, or that can be pulled inwards and extended outwards in a translatory, sword-like manner.

Such access control devices on the one hand should be as secure and tamper-resistant as is possible, in particular, to prevent unauthorized passing/access past the access control devices. On the other hand, the access control devices should have the highest possible intuitive and easy operation such that the access control devices do not scare off persons that are authorized to pass, but grant access in an inviting and simple manner.

Although conventional access devices such as turnstiles, for singularization of a stream of people, having head-high turn stops, provide a relatively high protection against unauthorized access, said conventional access devices are relatively large, elaborate, difficult to operate, and have a deterrent appearance. On the other hand, simple turnstiles having, for example, a single blocking arm, are easy to get around and often do not meet the required level of security. The bulkier, higher security access control devices are also not very variable and usually have to be built in or adapted individually to the particular installation site. In addition, the anchoring of access control devices in sensitive environments such as listed buildings having precious and expensive floors is hardly employable.

An access control device for ski-lifts is already known from EP 23 06 406 B1, in which an RFID reader module is integrated in the barrier element in order to avoid separate fittings for reading RFID access cards and to achieve a compact, small design. To save power and to avoid unnecessary radiation, the RFID reader module is only activated once the approach of a person at the barrier element is detected by means of an additional sensor.

A similar access control device having a movable barrier element in the form of a single blocking arm that can be swung back and forth is known from EP 22 34 073 A1. In order to prevent a climbing over or crawling under the barrier element, sensors are mounted above and below the barrier element on the post-shaped portal on which the barrier element is movably mounted, for example, in the form of a light barrier or of a radar sensor, which trigger an alarm when climbing over or crawling under the barrier element is detected.

An access control device for ski-lifts is known from AT 509 119 B1, wherein support posts, positioned at the right and left of the access path, support a swiveling barrier element. In addition, protruding plastic bodies are attached to the support posts parallel to the access path, in which support posts readers for RFID smart cards or similar access openers are housed. To support intuitive operation, lighting fixtures are also attached to the support posts in order to illuminate said receiving bodies for the card reader in the manner of a traffic light. For example, if a valid card is recognized by the reader, the reader housing is lit green, while the reader housing can be illuminated in red, when an invalid card is read.

Furthermore, a revolving door is known from DE 10 2010 024 108 A1, the swing leaves of which consist of glass panels and are combined to form a turnstile which can be driven by an electric motor. To set the electric motor in motion, on the one hand a sensor for detecting approaching persons is located on the drum which partly surrounds the revolving door and is arranged in a fixed manner, and on the other hand a door activation switch for manual operation is provided.

SUMMARY OF THE INVENTION

Proceeding from this, the problem addressed by the present invention is that of providing an improved access control device of the aforementioned type which avoids the disadvantages of the prior art and further develops the latter in an advantageous manner. In particular, a variable usability and reversible usability in various places, including changes in sensitive buildings, without permanent impairment of the installation location is to be achieved while at the same time achieving high security against unauthorized access.

It is therefore proposed, not to anchor the access control device rigidly to the floor, but to construct and set the access control device up as a self-standing unit which is movable on the floor. To allow flexible use at different locations without complicated installation work, to be able to variably delimit different spatial areas, for example, in a casino or a meeting room, according to an aspect of the present invention the movable barrier element can be supported on a barrier carrier which is constructed as a free-standing element that has its own means of ground contact for an anchorage-free, variable-positioning set-up of the barrier element on the floor. By means of such a barrier carrier having said ground contact means, the access control device, in particular, also can be used functionally without any anchorage to the ground, wherein the means of contact to the ground can be advantageously designed such that the means of contact to the ground can be moved, such that the entire access control device, but at least the barrier element, can be moved along the floor and relocated. Such foundation-less, anchor-free mounting of the access device allows for the access device to be set up on precious floors, for example, in listed buildings.

The access device an, In particular, form a mobile, tool-free removable assembly that can be set-up depending on local conditions, and, if necessary, can be pushed or moved by hand, if necessary by means of lifting aids, to other standing locations.

The floor recess means, the access device is inherently stable, tilt-proof and statically stable and is thereby designed without interlocking floor or wall locking means such as ground anchors, soil dowels, and screws. In particular, the access device and means of ground contact alone can be frictionally fixed on the floor and be held in the required direction and position.

In particular, a base plate can be provided, the underside of which can form said ground contact means or the base plate of which can be connected to said ground contact means. For example, the base plate can form the contact surface directly on the bottom surface thereof, wherein said contact surface can be constructed at least approximately flat. As an alternative to a large-surfaced, flat contact surface, the base plate can have on the underside thereof, projections or bulges and/or optionally, a non-slip and/or dampening coating that conserves floors and avoids scratches, such that the whole underside of the base plate does not stand on the floor, but only the projections or coated areas mentioned, for example, to ensure a level footing on uneven floors. Alternatively or additionally, a supporting arm or the like may be attached to the base plate, to form said ground contact means. The base plate needs not form a panel in the strict sense in terms of a flat panel, but can be embodied in the form of a support or frame structure or of a truss structure or similar rigid structure whose contact points are in a plane or advantageously are designed such that the contact points can be adjusted.

To prevent accidental slippage of the access device upon actuation of the barrier element, the footprint of the means of ground contact may have a non-slip design, preferably rubber or soft plastic-coated or have an adhesive coated or non-skid surface. Depending on the floor on which the device is to be installed, a non-slip surface structure, for example, in the form of a rippling or the like, can be advantageous.

Advantageously, the base plate can be provided with a sufficiently heavy ballast weight to compensate or catch tilting moments which can be initiated by pressure and impact forces against the barrier element or against an other section of the access device. Such a ballast weight can be implemented by a sufficiently heavy design of the base plate, for example, made of a sufficiently thick metal panel. Advantageously, the ballast weight can also include a detachable additional weight, which can be connected to the means of ground contact and the bottom plate and which can be removed. As a result, the transport or moving of the access device can be made significantly easier.

To avoid tilting, it is also advantageous for the means of ground contact, with respect to the ballast weight, to be provided with a sufficient lever arm, for example, by an adequately large set-up area and/or contact points or surface pieces sufficiently spaced apart. For example, the bottom plate can have an extension that corresponds to at least half the turnstile circumference, the arm of which forms the barrier element.

In particular said support bearing the harrier element, in particular in the form of a turnstile or pivot post, can be underpinned on such a base plate, such that the support, in particular a turnstile or pivot post, does not need to be anchored to the ground.

Advantageously, the aforementioned base plate can connect the support bearing the barrier element, in particular, the turnstile post or pivot post, by means of a side limit enclosing the access, in particular in the form of a portal post, such that the support of the barrier element and the side limit above the base plate form a structural unit that can be set-up in a simple manner.

In particular, the turnstile post or pivot post bearing the barrier element can be supported on the floor by means of a lower end on the bottom plate and linked by an upper end to a portal cross element, which is connected to said portal posts. The portal, the bottom plate, and the turnstile or the pivot post having the barrier element attached to the pivot post, can in particular embody a pre-assembly component and/or a structural unit, which can be positioned in varying locations and can in particular be moved on the ground by pushing in order to delimit a defined area.

The base plate can at least be relatively thin (for example, in the range of a few millimeters) in a certain section, such that in the through-way area, in particular when a person on the other side of the rotary post goes through, no hazards of tripping exist. The base plate in this through-way area can be chamfered longitudinally on one or both sides. For example, the base plate in a through-way passage area crossed by people walking through can be thinner and/or the edges can be beveled and are designed thicker in the areas outside of this overflow area.

In order to delimit different room areas variably and to allow the adaptation of structural spatial elements such as walls and the like, according to a further aspect of the present invention, a side limit is provided which laterally encloses the at least one barrier element and/or a continuing side limit is provided, which has a modular design and is assembled from a plurality of side parts, which can be put together in variable ways and together form said side limit. Such modular side limit of the access device, having angularly variable or kinking or pivoting side panels, enables the simple connection of the access device to spatial structures such as room walls, even when there are different room dimensions.

The side limit can also be advantageously connected to the Portal-like side enclosure, in particular, to the lateral Portal posts in the style of bending and/or torsion-resistant fixture, so that the side limit and the Access Device or its Portal-like side enclosure support and brace each other. In conjunction with the base plate or the means of ground contact of the barrier support, the supporting effect of this means of ground contact can brace the side limit. Conversely, the side limit can further brace the barrier support, in particular against lateral tilting towards the side limit.

In the further development of the invention, the side panels can be connected to one another in an articulated manner by coupling means, such that the side panels can be mutually positioned to each other by pivoting in different angular positions. The coupling means are connected advantageously as releasable such that a different number of side panels in said manner can be connected with each other, depending on how long the side limit shall reach.

The coupling means can in particular realize an upright hinge axis, that connects the adjacent side parts to one another, such that the adjacent side parts can be hinged relative to each other around the connected upright axis. Advantageously, the side limit can be connected in an articulated manner to a side limit enclosing the access which can be blocked by the barrier means by means of corresponding coupling means, in particular in the form of a portal post, connected and relative to said side limit in different angular positions. In particular, the side limit can be advantageously hinged around an upright axis opposite the portal that frames the access.

To further increase the tilting stability of the passage portal and the access device, at least one of the side panels can be placed in an angular orientation in which the panel-type side panel is inclined and extends with an acute or obtuse angle to the upright passage level, by the passing users going through the barrier element. For example, at least one side panel can be placed at an angle to the passage portal with more than 30° angular displacement. Advantageously a plurality of side panels placed next to each other in a chain-like manner that are connected to one another can be arranged in an increasingly inclined manner with respect to the passage portal.

By interleaving the side panels to each other, the side panels can be set up in a stable and detached manner. Foot holds mounted on the side panels can form a stable or triangular foot hold due to the bent arrangement of the side panels to each other.

Some or all of the side panels of the side limit can advantageously also have freestanding and inherently stable base parts similar to the described ground-contacting agents of the barrier carrier to set up the side limit on the floor in an anchor-free, variable-position manner. By means of such foot pieces the side limit can be used functionally even without anchorage in the ground, wherein the foot portions may advantageously be formed on the bottom to displace the entire access control device including the side limits thereof on the floor.

Said foot parts can have a slip-trained surface, preferably made from rubber or soft plastic-coated, glue-coated or non-skid material. Depending on the floor on which the device is to be installed, a non-slip surface structure, for example, in the form of a rippling or the like, can be advantageous.

To create an inviting, intuitive operable access means, at least one barrier element may be designed illuminated to give by illuminating the barrier element to the access seeker light signals. An appropriate illumination device is provided to illuminate the movable barrier element. By illuminating the movable barrier element itself, the corresponding light signals for access seekers are particularly easy to identify. Secondly, no separate components are required, which would require additional space, such that overall a small-sized, compact design of the access control device can be achieved.

In an advantageous further development of the invention, said illumination device can be associated with the barrier element such that the illumination device moves together with the barrier element when the barrier element is moved into the barrier position thereof and/or in the access position thereof. In particular, the illumination device can be integrated into the barrier element, for example, housed inside the barrier element or at least arranged directly on the barrier element. By an arrangement of the illumination device that moves with the barrier element, an equally high-quality of lighting can be achieved by means of a simple embodiment of the illumination device in the various positions of the barrier element. The barrier element can illuminate uniformly or be illuminated uniformly, regardless of the position in which the barrier element is located and/or whether the barrier element is being moved or is resting.

In a further development of the invention, the illumination device may be associated with the barrier element such that the barrier element can be illuminated and/or translucent from the inside. As a result, the barrier element has a high luminosity from different angles.

To achieve at least a good visibility in the illuminated state, in an advantageous further development of the invention, the barrier element can comprise a light-emitting panel preferably, approximately plate-shaped, whose front is surface illuminated by the illumination device. Thereby said front side is the largest side of the light-emitting panel with regards to the surface, which light-emitting panel, in the blocking position of the barrier element, is aligned transversely by the access control device or is oriented approximately perpendicular to the view axis of a person moving through the access control device. The light-emitting panel may thereby form a substantially flat plate, but alternatively can also have some curvature, for example, in terms of a bulging surface, wherein the surface may advantageously be at least contoured approximately smooth or at least have a harmonious contour. Alternatively, a relief-like contour of the light-emitting panel is generally possible, for example, in order to achieve special lighting effects.

Hereby the surface illumination of the light-emitting panel can be generally done in various ways. For example, a grinding slanting irradiation of the front side to be illuminated can be provided at an acute angle of the light arriving from the illumination device. The illumination device can thereby comprise at least one light source at one edge of the light-emitting panel, the light of which light-emitting panel is emitted at an acute angle diagonally on the front side and from the front side is reflected or scattered such that the front side is flatly lit. Alternatively or additionally, if necessary, the back side can be irradiated in the said grinding manner, such that the light passes through the light-emitting panel that is, at least in this case, transparently or translucently formed, and can be radiated on the front side. The light-emitting panel can thereby be reflective, at least in some sections, and/or can scatter light, for example, be satin-formed.

Alternatively or in addition to such a lighting of the front and/or back of the light-emitting panel coming from the outside, the light-emitting panel can, however, in a further development of the invention, also be illuminated from the inside. For this purpose, the light-emitting panel can, at least in some sections, be formed of a light-conducting material and turned with at least one of the narrow sides of the light-emitting panel towards the illumination device, such that in the narrow side of the illumination device, light from the illumination device can be coupled. The coupled light can propagate in the light-conducting material of the light-emitting panel and can be radiated on the front and/or back side of the light-emitting panel, for example, by means of a refractive forming of the front and/or back side.

The illumination device may comprise at least one light source which is arranged in the narrow side of the light-emitting panel and irradiates light onto the aforementioned narrow side.

In an advantageous further development of the invention, the aforementioned illumination device may comprise a line of LEDs that can sit directly on the so-called narrow side of the light-emitting panel, in particular be attached thereto. Alternatively, the so-called LED lighting strip however, can also be arranged spaced away from the narrow side, for example, can be positioned on an edge on the light-emitting panel frame and/or support element, which encloses the light-emitting panel on the edge thereof at least in some sections. However, a direct arrangement of the LED lighting strip on the narrow side of the light-emitting panel can be advantageous in order to achieve the highest possible coupling gradient.

In the further development of the invention, said LED light strip can be arranged between the narrow side of the lighting panel and the frame enclosing the lighting panels, whereby in an advantageous further development of the invention, said frame has a multi-limbed, for example L-shaped or U-shaped cross-section and the lighting panel can be covered on at least two sides, in particular, said narrow side and in the area of a narrow edge strip of the front or rear side. In a U-shaped cross-sectional configuration of said frame part the light-emitting panel can be encompassed on three sides, namely from the narrow side and the two adjacent, opposing front and rear sides. In this way, a protected arrangement of the LED lighting strip can be achieved.

Regardless of the position or the presence of an LED light strip, a frame-like enclosure of the light-emitting panel may be advantageous in order to prevent damage to the light-emitting panel and to make the barrier more resistant and strengthened. Advantageously, at least one light-emitting panel can be edged preferably with a frame which can be made of metal, a metal alloy or other similar resilient or resistant material.

In an advantageous further development of the invention, the mentioned enclosing frame part can take the form of an elongated thin profile part or the form of a narrow edge web, the thickness and height of which is very small compared to the extension and longitude of the light-emitting panel, in particular, encloses only a narrow edge strip of the light-emitting panel.

In an advantageous further development of the invention the entire surface of the light-emitting panel is illuminated by the illumination device. For example, only a small edge strip and, if necessary, an attachment section of the light-emitting panel, trimmed by the aforementioned edge web, is excluded from the illuminability. The non-illuminated surface and/or non-visible illuminated surface of light-emitting panel can be advantageously less than 10% of the entire surface of the light-emitting element.

To achieve an intuitive usability having a welcoming effect on persons authorized to access, the barrier element can, at least in some sections, be made of transparent material so that at least when the lights are switched off on the device, a view through the barrier element is permitted. In particular, the aforementioned light-emitting panel can be designed transparent or translucent, or sheer, respectively, to allow at least a relatively good visibility of the area controlled by the access control device when the illumination device is switched off. Such a design of the barrier element, that is at least partially transparent, allows, for example, to turn off the illumination device to enable an approaching user to see what is awaiting the user behind the access control device. By switching on the illumination device on the other hand, the visibility of the barrier element can be increased or supported to prevent an accidental collision with the barrier element. In addition, the lighting of the barrier element can also be used to selectively transmit to the person requiring access, information in the form of light signals. These can, on the one hand, be relatively simple light signals, for example, different colors of light, which can be achieved by different colored light source designs of the illumination device.

On the other hand, complex information can be transmitted to the person requiring access, for example, in the form of texts and/or images. For this purpose, a more complex illumination device can also be designed, for example, comprising a pixel-like illuminated dot matrix. For example, the illumination device can comprise at least one screen display element that can be incorporated into the barrier element and/or may form the barrier element. Such a screen display element can be formed, for example, as a flat screen. Alternatively or additionally, a display element from electronic paper having an image memory function for variable information display, can be provided. Such an electronic paper, sometimes referred to as e-paper, regularly includes at least two thin film layers between which micro-capsules can be included having differently colored pigment particles, which can be electrically charged. The two films serve as negative or positive electrodes, such that, depending on the application of the appropriate voltage, different pigment particles are oriented to the surface of the one or of the other film. In particular, each of the aforementioned film layers may comprise an electrode grid, whereby a pixel grid and thus a corresponding information presentation, such as on a screen, is possible.

Such electronic paper can be applied, for example, to the above-mentioned light emitting panel.

Alternatively or additionally, a complex display of information can also be achieved by a relief-like surface formation of the light-emitting panel, for example, by elevated or recessed letter contours, which give readable information when illuminated or back-lit.

Alternatively or in addition to a visual presentation on the barrier element, the access control device can comprise an acoustic device that can communicate acoustic information and signals to a person using the access control device or approaching the device. In particular, notifications of actions related to the access control, such as activating the barrier element, the refusal of access, or the triggering of other safety devices such as light barriers and the like can be indicated acoustically. For this purpose, when further developing the invention, the acoustic device can comprise at least one speaker, which can advantageously be provided on a structural element of the access control device, such as an enclosure of the access or a portal, with which the named barrier element cooperates.

The barrier element illuminated in the aforementioned manner can basically be stored and arranged in various ways. According to an advantageous further development of the invention, the barrier element can be designed as an arm of a turnstile. Alternatively, the barrier element can also embody a back and forth swinging flap in the type of a flap gate or up and down-moving rocker in the type of a barrier. Furthermore, the barrier element can also be in the manner of a retractable and extendable sword that can move translational in the locking position and in the access position.

To achieve a high level of security against unauthorized access in terms of exceeding or falling through the barrier element, a sufficiently large area, in particular sufficiently high and ground level construction of the barrier element can be provided in a further development of the invention. If a transparent or at least sheer light-emitting panel is used in the manner described above for the barrier element, a welcoming effect can be achieved with an intuitive and simple handling and a deterrent effect can be avoided.

Alternatively or additionally, a plurality of barrier elements can be arranged one above the other and together form an access barrier in an advantageous further development of the invention, wherein said plurality of barrier elements advantageously can be at least approximately arranged in a common, in particular upright plane. Said multi-barrier elements can thereby form strip-shaped locking arms, which can be configured in the aforementioned manner respectively as light-emitting panel and can be spaced apart from each other. As a result, different lighting effects can be implemented in various sections of the barrier in a simple manner, for example, by illuminating various barrier elements in different ways.

To further improve the security of the access control and, for example, to avoid improper climbing over or crawling under of the barrier element, an advantageous further development can provide a sensor monitoring device for monitoring the access blocked by the at least one barrier element, wherein the sensor installation can, in particular, monitor an area unrestricted by the barrier element and/or is able to monitor an area adjacent to the barrier element. In an advantageous further development of the invention, the sensor installation can monitor an area above the at least one barrier element in the locking position thereof and/or an area below said barrier element, wherein the sensor installation can advantageously be of such a nature that a signal is given in cases of intrusion of an object into said areas, for example, to trigger an alarm, which can be issued, for example, to the aforementioned acoustic device.

The sensor alignment can be coupled to a control device of the access control device to only emit a signal when the barrier element is in the blocking position thereof and/or is not released, to avoid incorrect indications when an authorized person passes the access.

Said sensor installation can be constructed differently, for example, comprising a light barrier sensor system and/or a radar sensor. The sensor installation can advantageously be mounted to a side limit and/or to an upper limit that monitors the access. For example, the sensor system can be integrated into a portal which surrounds the access controlled by the barrier element. If the barrier element is integrated into a turnstile in the manner described above, the sensor installation can monitor the space above the turnstile which is monitored by the portal. The access control device can thereby include a plurality of access gates, for example, an access gate for controlled access to a room and an exit gate to exit from said area, wherein said exit gate can be designed as an emergency exit gate, for example. Said access gate and said exit gate can thereby have a different design, whereby, for example, in a further development of the invention, at least one access turnstile and at least one exit flap gate or one exit barrier can be provided. Said access turnstile and said exit barrier, and in particular, emergency exit barrier can each comprise at least one barrier element that can be illuminated, as described previously.

BRIEF DESCRIPTION OF THE DRAWINGS

The invention is explained in detail below using a preferred embodiment and associated drawings. In the drawings.

DETAILED DESCRIPTION OF THE INVENTION

Figure 1:
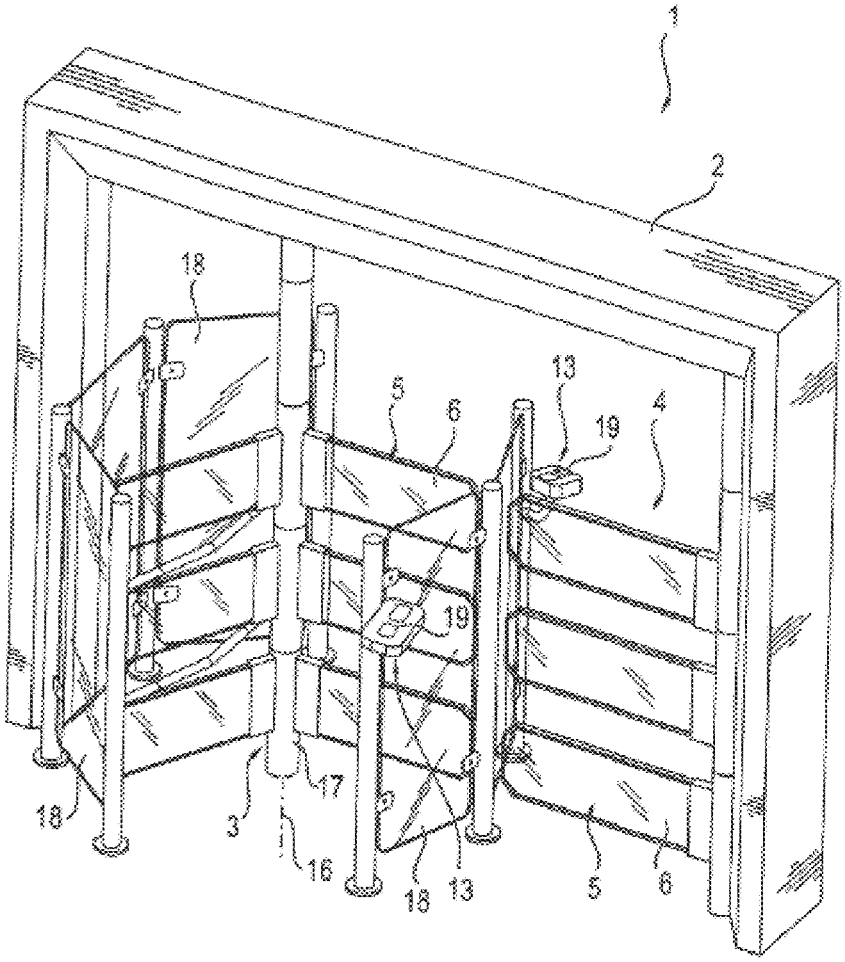
FIG. 1: a schematic, perspective view of an access control device according to an advantageous embodiment of the invention, which comprises, in addition to a turnstile having a plurality of locking arms, an exit gate having barrier elements that can be swung back and forth.
Figure 2:
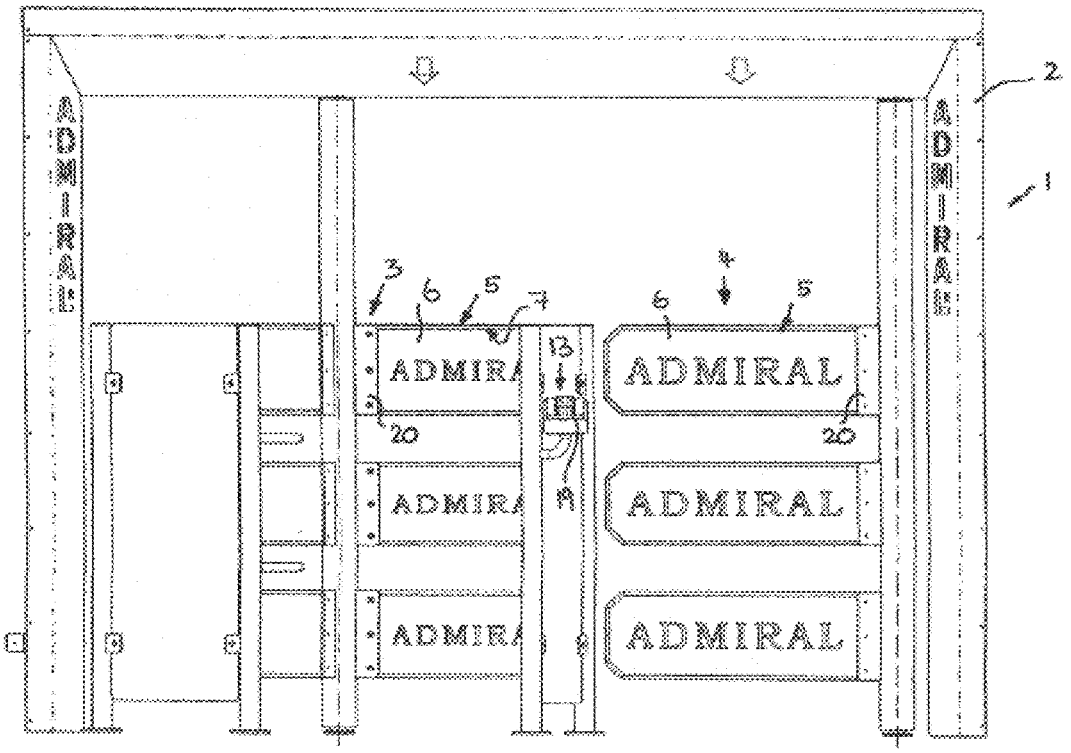
FIG. 2: a front view of the access control device from FIG. 1 that shows the access turnstile and the exit gate in a blocked position.

As FIGS. 1 to 4 shows, the access control device 1 can be configured as a person access control that separates an access-controlled room behind the access control device 1 from, for example, an area in front of the access control device 1. The access control device (1) can comprise a portal (2), which comprises two portal posts arranged on either side of an access path, onto which further blocking measures, such as walls, a fence or the like, can be connected. As shown in FIG. 1, said portal (2) can comprise a crossbar, which connects the portal posts with each other at the top, such that the portal (2) is formed overall in the manner of a door frame.

The access through said portal (2) is regulated by a movable barrier that can be designed in the form of a turnstile (3), and that can extend into the passage section enclosed and monitored by the portal (2). In particular, said turnstile (3) can comprise an upright axis (16), along which a central turnstile post (17) extends, which is mounted rotatably at the lower and/or upper end thereof and can be rotationally driven by a drive in a generally known manner, which drive is not shown in more detail here.

Figure 3:
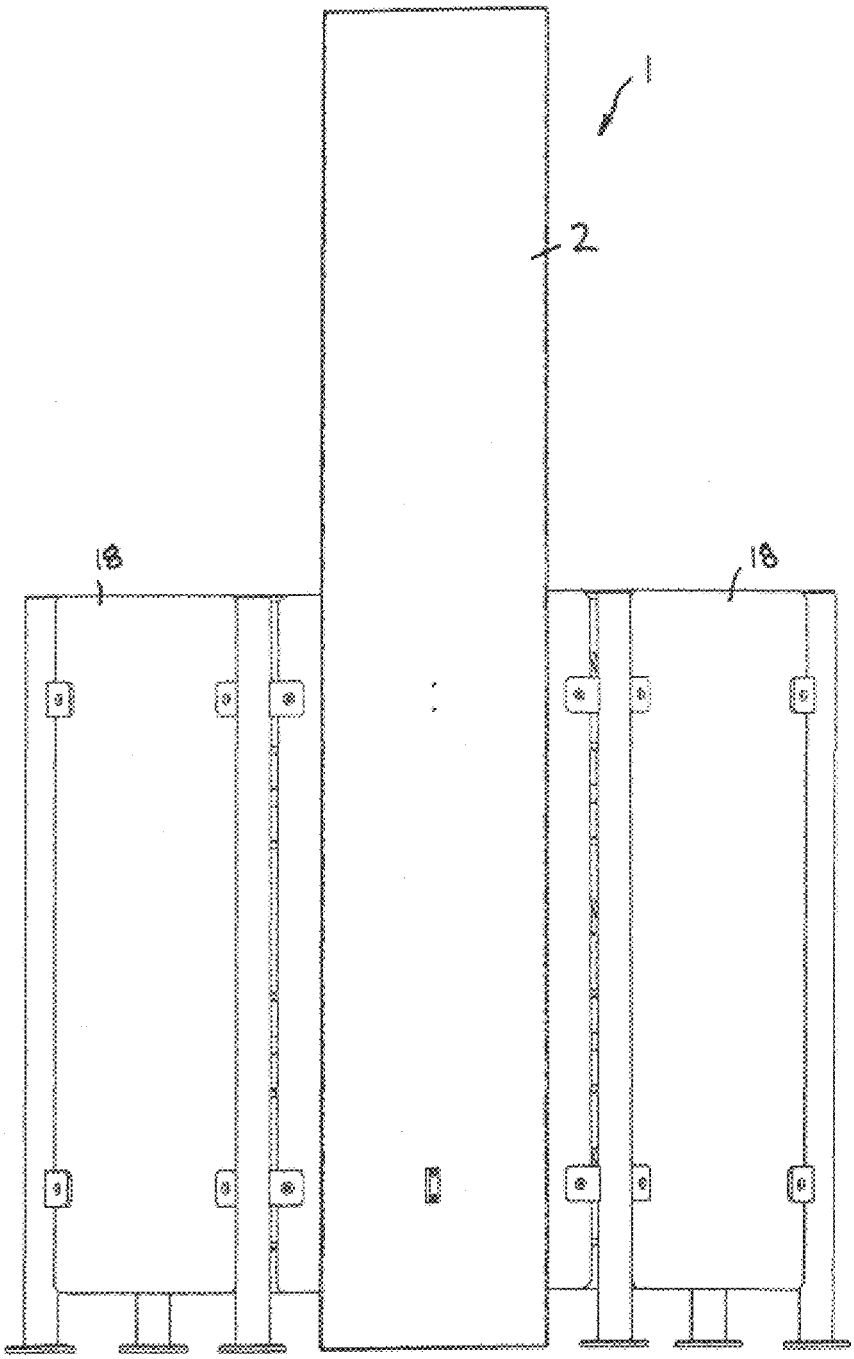
FIG. 3: a side view of the access control device of the preceding figures.
Figure 4:
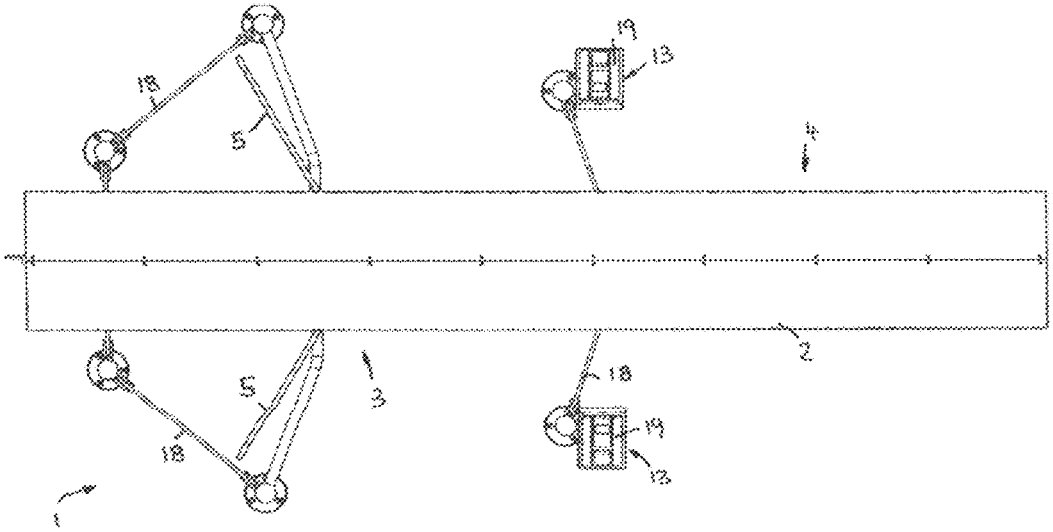
FIG. 4: a plan view of the access control device from the preceding figures.

Crosswise projection barrier elements (5) are fixed on said turnstile post (17), which can be distributed circumferentially around the turnstile post (12) in a plurality of groups, according to FIG. 3 in three groups, to subdivide the area around the turnstile post (12) into a plurality of sectors.

Advantageously, a plurality of barriers elements (5) are each arranged above one another, which can lie in an upright plane, as FIG. 1 shows, but optionally can also have a slight offset to each other, for example, to grant more leg and knee clearance. Advantageously, the barrier elements (5), approximately arranged at one level, extend close enough to the ground to prevent sliding or crawling under the barrier, and on the other hand, extend high enough to prevent climbing over. On the whole, a head-high barrier can be designed, which, as FIG. 1 shows, can consist of a plurality of superposed barrier elements (5). Alternatively, it would also be possible to design a barrier element (5) so high that a corresponding head-high barrier is formed.

The turnstile (3) and the barrier elements (5) sweep over an approximately cylinder-shaped space, which may be surrounded by an approximate drum-shaped arrangement of boundary walls (18). As FIG. 1 shows, said boundary walls (18) can be formed from glass or plastic panels, which are fastened to the boundary posts.

Said turnstile (3) forms, in this respect, an access gate and thereby controls the access. For example, the turnstile (3) can, in principle, be blocked and by means of detection sensors (13) can be released when a person seeking access and/or the authorization of a person seeking access is detected. For example, said detection sensors (13) can comprise an identification reader (19) by means of which an RFID chip, an identity card, or similar access codes, for example, can be read. Optionally, fingerprint readers, iris readers, or simply entrance card readers, for example, are conceivable.

If the turnstile (3) has a rotary drive, the drive can be set in motion by the detection sensors (13) when a person authorized to access is detected, to continue the rotation of the barrier elements (5) at the turnstile (3) and to thereby give access.

As FIG. 1 shows, in addition to the turnstile (3) a further access or exit gate can be provided, which can likewise be blocked by three superposed barrier elements (5) and regularly blocked and released by detecting sensors (13) in a similar manner as already described.

The barrier elements (5) of the exit gate (4) can be configured as pivoting flaps or as a flap gate respectively, whereby the horizontally arranged barrier elements (5) may be pivotally mounted at one end around upright pivot axes. The exit gate (4) can in particular serve as an emergency exit.

Similar as described for the turnstile (3), the barrier elements (5) of the exit gate (4) can also form an entire head-high barrier to prevent both climbing over and going under the barrier.

Figure 5:
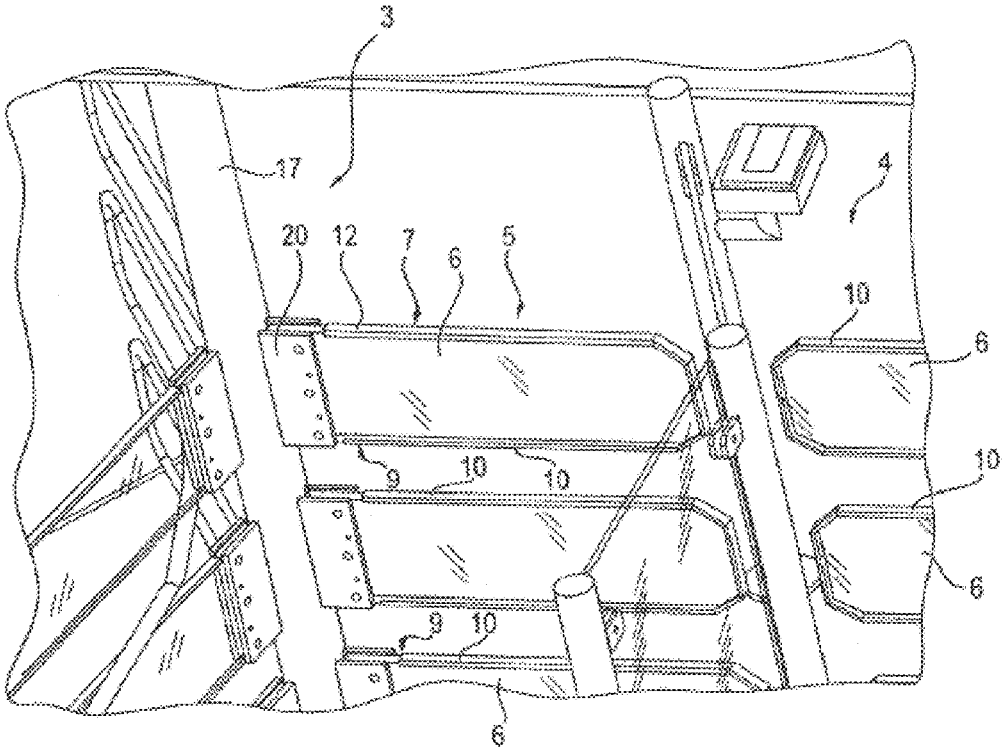
FIG. 5: a partial illustration of one of the barrier elements of the turnstile, showing the mounting of the light-emitting panel at the turnstile and showing the LED lighting strip arranged on a narrow side of the transparent and light-guiding formed light-emitting panel.

As shown in FIG. 5, the barrier elements (5) each comprise a transparent and illuminable light-emitting panel (6), which may be entirely plate-shaped and may consist of a transparent, light-conducting material such as glass or plastic. Said light-emitting panels (6) are held at one of the edge sections thereof, for example, by two mounting flanges (20), between which an edge portion of the respective light-emitting panel (6) may be sandwiched and clamped.

The illumination device (7) for illuminating the light panels (6) of the barrier elements (5) can further comprise LED light-emitting panels (12) which can be arranged on a narrow side of the light-emitting panels (6), and can be glued, for example, to the light-emitting element see FIG. 5. Said LED lighting strips (12) can be also extend along at least one of the long narrow sides of the light-emitting panel (6), if necessary, also running around several small sides of the light-emitting panel (6) or each piecewise on the upper and lower narrow side of the light-emitting panel (6).

In particular, the aforementioned LED strips (12) can be arranged between the respective narrow side of the light-emitting panel (6) and the frame which surrounds the respective light-emitting panel (6) edge. This edging can, for example, be formed from an edge web (10) which has a U-shaped cross-section and the edges of the respective light-emitting panel (6) can surround on three sides, such that the LED lighting strip (12) is seated in the bottom of the U-shaped recess of the edge web (10). Through this edge web (10), see FIG. 5, the respective LED lighting strip (12) is protected from external influences.

The light emitted by the LED light strips (12) is initiated and irradiated through the aforementioned narrow sides into the light-emitting panel, such that the light can be distributed in the light-emitting panels (6) and then completely illuminates said light-emitting panels. By breaking, the light can emerge through the largest front and rear sides of the respective light-emitting panel (6), such that the light-emitting panel (6) is illuminated from the inside over the largest area.

In addition, or possibly as an alternative to such an internal illumination of the light-emitting panel (6), these can optionally also be irradiated from the outside, in particular, by an edge section of the light-emitting panel (6), such that the light emitted from the illumination device (7) falls, dragging at an acute angle, to the front and/or back side. For this, the illumination device (7) can comprise, for example, more LEDs or other light sources in the area of said mounting flanges (20), see FIG. 5.

The illumination device (7) can advantageously comprise different colored light sources and/or variable light sources in the color temperature, so that the barrier elements (5) can be illuminated in different colors and different lighting effects can be achieved. For example, differently colored LEDs in the form of the previously described LED light strips (12) can be provided. Here, different colored light sources can be provided on the barrier elements (5) and/or light sources having different color temperatures arranged on different barrier elements (5).

Depending on the location and purpose of the access control device (1), the illumination device (7) can be driven in various ways. For example, different lighting effects can be basically achieved when used in a casino or an amusement venue, in the form of changes in light color and/or intensity in the form of changes in the color of the illumination, light pulses by switching on and off or pulsed changes of the light color and/or intensity.

Figure 6:
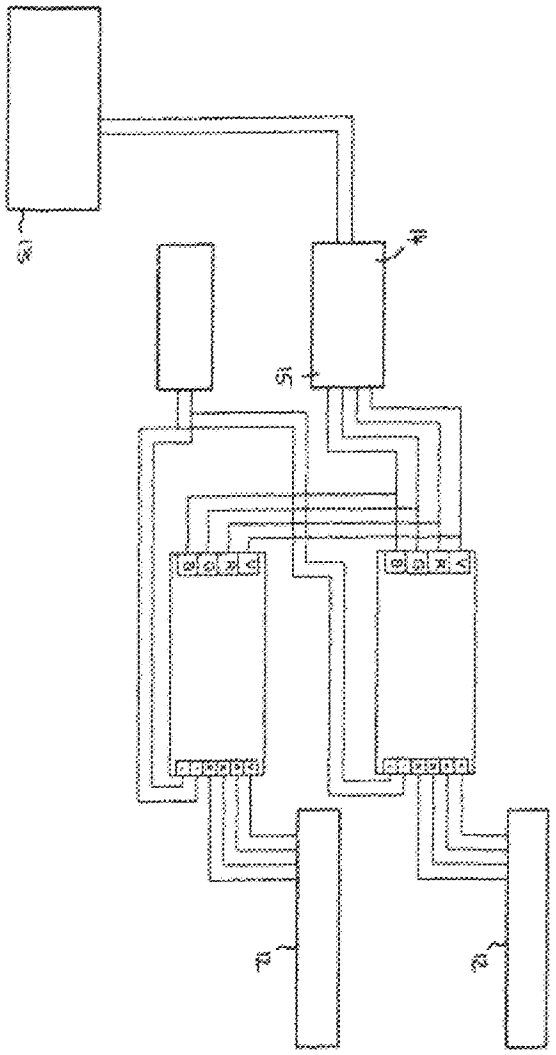
FIG. 6: a schematic circuit diagram for controlling the LED strips on the barrier elements.

In an advantageous manner, the illumination device (7) can also be driven by controllers (14 and 15) that take into account the movement of the turnstile (3) and the barrier elements (5) respectively and/or signals of the detection means (13), see. FIG. 6. For example, the barrier element (5) of the turnstile (3) can be lit in another way, whether the turnstile is revolving or whether the turnstile (3) is stationary. For example, pulsed or flashing lighting of the barrier elements (5) can be provided when the turnstile (3) rotates, while a static or constant illumination can be generated when the turnstile (3) is still.

Alternatively or additionally, the illumination device (7) can be variably controlled in dependence of the detection of a person seeking access or of the authorization of said person. For example, if a valid ticket or a valid entrance card is detected by the ID reader (19), a green lighting of the barrier elements (5) can be provided, while upon detection of an invalid ticket, a red illumination of the barrier elements (5) can be provided.

Figure 7:
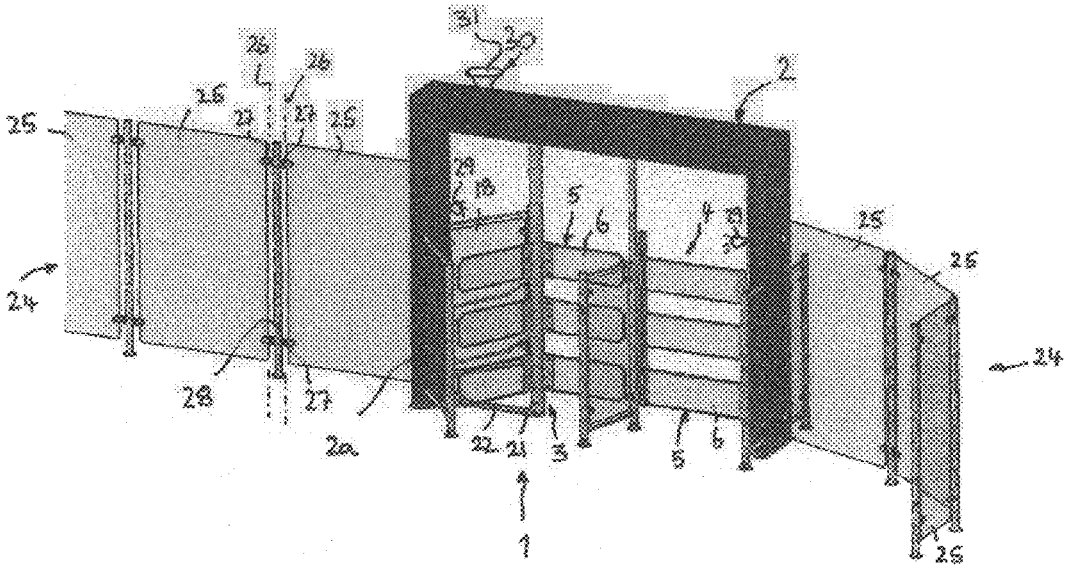
FIG. 7: a schematic, perspective view of an access control device similar to FIG. 1, in which the turnstile is mounted on a related portal base plate and on the portal, a modularly constructed, several side-stranded side barrier is connected.
Figure 8:
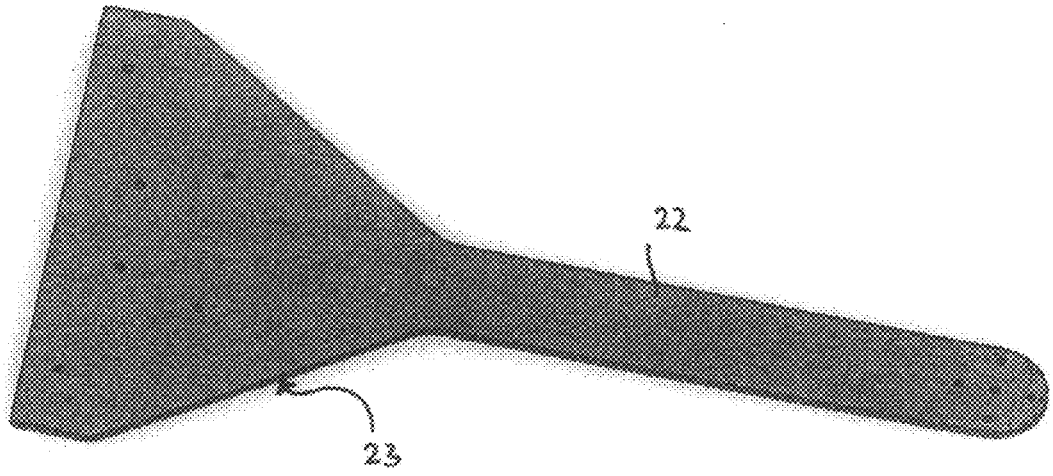
FIG. 8: a top perspective view of the supporting bottom plate of the turnstile of FIG. 7.

FIG. 7 shows another embodiment of the access control device (1), which basically corresponds to the embodiment according to FIGS. 1 to 6) in many details, in particular regarding the formation of the barrier elements (5) that can be illuminated or is similar to the embodiment according to FIGS. 1 to 6), such that reference is basically made to the above description. Basically, all embodiments of FIGS. 1 to 6 also apply to FIGS. 7 and 8. The embodiment according to FIGS. 7 and 8 have the following further characteristics:

As FIGS. 7 and 8 show, the turnstile (3) can be advantageously braced, in particular the turnstile post (21) thereof, on a base plate (22), which may advantageously be connected to the portal (2) enclosing the access, in particular the portal post (2*a*) of said portal. Said base plate (22) can be rigidly connected to the portal post (2*a*) at the lower end of said portal post (2*a*), for example, be screwed or attached in some other way and can extend to the lower end of the turnstile post (21), which, for example, can be supported via a roller or plain bearing or another pivot bearing on the bottom plate (22) in a rotatable manner. As a result, no ground anchoring for the turnstile (3) is necessary. In addition, the whole access control device (1) can be set up in a simple manner at different locations, for example, pushed along or relocated on the floor, without the portal (2) having to be adjusted relative to the turnstile (3).

The base plate (22) forms advantageously a free-standing, anchorage-free, means of contact with the ground (23) whose position can be variably adjusted for the barrier support of the movable barrier element (5), which barrier carrier can be in the form of the turnstile (3) shown. Furthermore, as FIG. 7 shows, a side barrier (24) having a modular design can connect to the portal (2) on the side, which side barrier can be composed of a plurality of side panels (25) variably in different configurations.

Said side panels (25) can form, for example, wall elements, for example in the form of at least partially transparent panels made of an at least partially transparent material such as glass or plastic, for example, Plexiglas, whereby, instead of such sheet panel elements, other side panels, for example, in the form of a grid, of a slatted fence, or of similar embodiments can be provided. If the side parts (25) include partially transparent and/or light-guiding panels as mentioned above, the side panels (25) can be basically lit and be provided with an illumination device, as previously described for the barrier elements (5), such that different lighting effects can be brought to the area of the side panels (25). In this respect, the barrier element (5) is subject to the previous description.

The side panels (25) are connected to one another and are releasable, namely advantageously such that the side panels (25) can be set-up to one another in different angular positions in an articulated manner. In particular, between adjacent side panels (25), means of hinging articulation can be provided, that can realize an upright hinge axis such that adjacent side panels (25) can be hinged relative to each other along the side thereof, facing neighboring side edges.

As shown in FIG. 7, connector posts (26) can be provided in between the side panels (25), on which connector posts the side panels (25) may be respectively redirected about a vertical hinge axis (26) in a pivotable manner. Said connecting posts (28) can thereby have their own coupling means (27) for each connectable side panel (25), such that the adjacent side elements (25) can pivot about two separate hinge axes. However, it is understood that a common hinge axis (26) may be provided between two adjacent side panels (25).

The side limit (24) is advantageously also hinge-connected to the portal (2), and thus likewise advantageously around an upright hinge axis (26). Here, the portal posts (2*a*) and/or the side panels (25) can be equipped with the corresponding coupling means (27), see FIG. 7.

To avoid climbing over the turnstile (3) and/or over the neighboring exit gate and/or passing or crawling below the lowest barrier elements (5), a sensor monitoring the space above and below the turnstile (3) or the top and bottom barrier element (5) can be provided. A corresponding sensor installation (9) may be configured for example in the form of a light barrier and/or can comprise radar sensors that monitor said defined area. Advantageously, the sensor installation (29) can be integrated into the portal (2) or be attached thereto. For example, light barrier sensor elements can be mounted on the portal posts (2*a*), placed opposite each other, such that the light barrier sensor elements communicate with each other above and/or below the upper and lower barrier elements and detect unauthorized passage. See FIG. 7.

Furthermore, as FIG. 7 shows, an acoustic device can be provided, for example attached to the portal (2), such that information and signals can also be transmitted acoustically. For example, an acoustic notification on actions related to the access control such as release, refusing access, activating light barrier, etc. can occur. For example, the message "Please pass" can communicate to a user that the turnstile (3) is unlocked. Alternatively or additionally, the acoustic device can be connected to the aforementioned sensor installation (29) for signaling unauthorized climbing over the turnstile by means of an alarm. The acoustic device (30) can include a speaker (31), for example, on portal 2, see FIG. 7.

The invention claimed is:

1. An access control device comprising modules including at least one side limit and a plurality of side panels interleaved into each other, and at least one barrier element (5), which is movably mounted on a barrier support and can be moved into a blocking position, in which the barrier element blocks access, and into an access position, in which the access is unblocked, the barrier support having a detachable base plate (22) in contact with a floor or ground, the detachable base plate (22) being anchorage-free and positionally adjustable, the at least one side limit, the plurality of side panels interleaved into each other, and the at least one barrier element (5) mounted on the barrier support having the detachable base plate (22) variably delimiting different spatial areas having varying structural spatial elements, said modules bounded by posts that define a portal (2).

2. The access control device according to claim 1, wherein a turnstile post or pivot post (21) bearing said barrier element (5) is supported on the barrier support having the detachable base plate (22).

3. The access control device according to claim 2, wherein the detachable base plate (22) further comprises a ground contact means (23) having an at least approximately flat supporting surface, which is formed by a lower face plate surface of the detachable base plate (22).

4. The access control device according to claim 3, wherein said base plate (22) connects the turnstile or pivot post (21) bearing the barrier element (5) by means of a side limit which surrounds the access as a portal post (2*a*).

5. The access control device according to claim 4, wherein the barrier element (5) bearing the turnstile or pivot post (21) can be supported on the floor with a lower end on the base plate (22) and is linked at an upper end to a portal cross-element (2*b*), which is connected with the portal posts (2*a*).

6. The access control device according to claim 1, wherein lower end on the base plate (22) further comprises a rubber or soft plastic base coat.

7. The access control device according to claim 1, wherein lower end on the base plate (22) further comprises a removable ballast weight stabilizer, the removable ballast weight stabilizer intercepting and mitigating tilting moments generated by horizontal actuation forces against the barrier element (5).

8. The access control device according to claim 1, wherein the access control device forms a mobile, tool-free removable assembly unit.

9. The access control device according to claim 1, wherein a side barrier (24) surrounding the barrier element (5) on sides of the barrier element (5) and continuing the barrier element (5) has a modular design and can be composed of the plurality of side parts (25), which are variable joinable in different angular positions, which possess stilts that can be moved on the floor or ground, and which together form the side barrier (24).

10. The access control device according to claim 9, wherein the side parts (25) can in each case be connected to one another in an articulated manner by coupling means (27) and can be positioned to each other in various angular positions by pivoting about said coupling means.

11. The access control device according to claim 10, wherein two adjacent side parts (25) are connected to each other by an upright hinge axis (26).

12. The access control device according to claim 9, wherein the side barrier (24) can be connected to a portal (2) enclosing the access.

13. The access control device according to claim 12, wherein the connecting means incorporate coupling means (27) through which the side barrier (24) can be connected in an articulated manner to the portal (2) to form a side limit and can be brought opposite said side limit into different angular positions.

14. The access control device according to claim 13, wherein the light-emitting panel (6) is enclosed at an edge thereof at least in some sections by a frame part or support part (9) in the illumination device (7), wherein the illumination device (7) has an LED lighting strip (12) which is arranged on the narrow side of the light-emitting panel (6), which LED lighting strip (12) is arranged between the narrow side of the light-emitting panel (6) and the frame part (9) that encloses the light-emitting panel (6) on the edge side thereof, or said frame part (9) is formed as a frame web enclosing the edge of the light-emitting panel (6) from a plurality of sides, which frame web has a multi-limbed cross-section and covers not only said narrow side of the light-emitting panel (6), but also a narrow edge strip of the light-emitting panel (6).

15. The access control device according to claim 13, wherein the illumination device (7) comprises different colored light sources (8), which are distributed along the edge of the light-emitting panel (6).

16. The access control device according to claim 13, wherein the light-emitting panel (6) is constructed at least in some sections in a reflective or light-scattering manner, and wherein the illumination device (7) comprises at least one light source (8) arranged at an edge of the light-emitting panel (6), which light source (8) irradiates the front side of the light-emitting panel (6) from a front side in a slanting and oblique manner at an acute angle.

17. The access control device according to claim 1, wherein the at least one barrier element (5) forms an arm of a turnstile (3), a flap that can be swung back and forth, or a rocker that can move up and down.

18. The access control device according to claim 1, wherein a plurality of barrier elements (5) are arranged one above each other and together form an access barrier.

19. The access control device according to claim 1, wherein at least one turnstile (3) and at least one emergency exit barrier (11) is provided, wherein the turnstile (3) and the emergency exit barrier (11) in each case contain at least one barrier element (5).

20. The access control device according to claim 1, wherein an illumination device (7) for illuminating the movable barrier element (5) is provided.

21. The access control device according to claim 20, wherein the illumination device (7) is integrated into the barrier element (5) or disposed on the barrier element (5) in such a way that the illumination device (7) can be moved together with the barrier element (5).

22. The access control device according to claim 20, wherein the barrier element (5) is illuminated and shines through from the inside and contains an approximately plate-shaped light-emitting panel (6), which is formed at least in some sections of a light-conducting material, such that in a narrow side of the light-emitting panel (6) light from the illumination device (7), which comprises at least one light source (8) disposed on the side of the light-emitting panel (6), can be coupled in, which light propagates in the light-emitting panel (6) and is radiated through the front side thereof, such that at least one front side of the light-emitting panel (6) of the illumination device (7) can be illuminated in a planar manner.

23. The access control device according to claim 1, wherein at least one display element is provided, which is integrated into the barrier element (5) or forms the barrier element (5).

24. The access control device according to claim 23, wherein the display element is designed as a flat screen, or has a display module of electronic paper having an image storage function for variable information presentation.

25. The access control device according to claim 1, wherein control means (14) for controlling the illumination device (7) of the at least one barrier element (5) are provided depending on a movement of the barrier element (5), in particular such that the moving barrier element (5) is illuminated differently than the standing barrier element (5), and detection means (13) are provided for detecting an access seeker and and/or an authorization of the access seekers, wherein control means (15) are provided for controlling said illumination device (7) of the at least one barrier element (5) in dependence of a signal of the detection means (13).

26. The access control device according to claim 1, wherein at least one sensor installation (29) for monitoring a spatial region above, below, and on the sides of the at least one barrier element (5) is provided, wherein the sensor installation (29) can be controlled as a function of the operating state of the at least one barrier element (5) in such a way that an alarm signal upon detection of an object in the monitored spatial area is suppressed when the barrier element (5) is unblocked and is in the access position.

27. An access control device comprising at least one barrier element (5), which is movably mounted on a barrier support and can be moved into a blocking position, in which the barrier element blocks access, and into an access position, in which the access is unblocked, the barrier support having a detachable base plate (22) with a detachable ground contact means (23) on an underside thereof and a removable ballast weight stabilizer, the removable ballast weight stabilizer intercepting and mitigating tilting moments generated by horizontal actuation forces against the barrier element (5), the detachable base plate (22) with detachable ground contact means (23) being anchorage-free and positionally adjustable and setting up the barrier element (5) on a floor or ground variably delimiting different spatial areas having varying structural spatial elements and forming a mobile access control device from a tool-free removable assembly unit, said at least one barrier element (5) bounded by posts that define a portal (2).

28. The access control device according to claim 27 wherein the underside of the detachable base plate (22) further comprises a rubber or soft plastic base coat.

29. The access control device according to claim 27 wherein the underside of the detachable base plate (22) further comprises an adhesive coating or non-skid surface.

30. The access control device according to claim 27 wherein the detachable ground contact means (23) further comprises a plurality of projections or bulges.

31. The access control device according to claim 30 wherein the detachable ground contacting means (23) further comprises a non-slip or dampening coating.

32. The access control device according to claim 27 wherein the detachable ground contacting means (23) further comprises a supporting arm.

33. The access control device according to claim 32 wherein the detachable ground contacting means (23) further comprises a non-slip or dampening coating.

* * * * *